United States Patent [19]

Van Malderghem et al.

[11] Patent Number: 4,687,228

[45] Date of Patent: Aug. 18, 1987

[54] CARBON SECURITY SYSTEM FOR CREDIT CARD SALES

[75] Inventors: Edmund G. Van Malderghem, Lewiston; Thomas G. Pennock, North Tonawanda, both of N.Y.

[73] Assignee: Moore Business Forms, Inc., Grand Island, N.Y.

[21] Appl. No.: 898,573

[22] Filed: Aug. 21, 1986

[51] Int. Cl.[4] ..... B41L 1/20; B42D 15/00; B65D 27/28

[52] U.S. Cl. ..... 282/9 R; 283/81; 283/105; 229/69

[58] Field of Search ..... 282/9 R, 1 A, 1 R, 3 B, 282/8 B, 27 A, 28 R; 283/81, 103, 104, 105; 229/69, 70, 76; D19/5, 9, 11

[56] References Cited

U.S. PATENT DOCUMENTS

| | | | |
|---|---|---|---|
| 1,980,318 | 11/1934 | Caton | 282/9 R |
| 2,262,666 | 11/1941 | Curtis, Jr. | 282/9 R |
| 3,987,960 | 10/1976 | Gardiner | 283/81 |
| 4,236,731 | 12/1980 | Hektoen | 229/69 |
| 4,300,790 | 11/1981 | Griffin | 282/9 R |
| 4,403,793 | 9/1983 | McCormick et al. | 283/105 |
| 4,586,611 | 5/1986 | Scalzo | 229/69 |

FOREIGN PATENT DOCUMENTS

| | | | |
|---|---|---|---|
| 1569774 | 6/1980 | United Kingdom | 282/9 R |

*Primary Examiner*—E. R. Kazenske
*Assistant Examiner*—Paul M. Heyrana, Sr.
*Attorney, Agent, or Firm*—Cushman, Darby & Cushman

[57] ABSTRACT

A carbon security system is provided for a customer using a credit card to get all of the carbons when the customer copy is taken. Security is achieved because all carbons are connected to the customer copy and are removed together with the customer copy. A set made up of the customer copy and all carbons may be folded over so that the carbons are left inside of the folded customer copy. A strip of adhesive attached to the top side or underside of the stub retains the folded set together. Thus, there results a very good way for the customer to retain the carbons without getting a mess on his or her hands and without risking fraudulent use of credit card data obtained from the carbons.

5 Claims, 8 Drawing Figures

CARBON SECURITY SYSTEM FOR CREDIT CARD SALES

BACKGROUND OF THE INVENTION

1. Field of the Invention

The present invention relates to a carbon security system for a customer using a credit card.

2. Description of the Related Art

Fraudulent use of credit card data obtained from carbon papers carelessly discarded by a merchant or customer or wrongfully retained by an unscrupulous employee of a merchant has led to the necessity of redesigning the credit card sales invoice. One redesigned sales invoice is disclosed in U.S. Pat. No. 4,403,793. However, the carbons must be separated midway of the account number. This separating process is messy and troublesome, particularly for a customer in a hurry or for an honest employee who is very busy.

SUMMARY OF THE INVENTION

A primary object of the present invention is to provide a construction of a credit card sales invoice set which is clean and easy to use and also results in higher security for the customer. There are two preferred embodiments of the present invention.

In one construction, an adhesive is coated underneath the stub of a bottom card copy so that the top copy for the customer may be folded over and adhered at its free end to the adhesive, thus sealing the messy carbons inside.

In the alternative construction, the adhesive is placed on a removable bottom stub between the second and bottom card copies. The second and bottom card copies are removed at their perforation lines and the bottom ply of the stub is then removed to expose the adhesive for use. The top copy for the customer is thereafter folded over and adhered to the adhesive in order to obtain the same result as the first preferred embodiment.

The advantages of the present invention will be more fully understood from the following description of the drawings and the preferred embodiments.

DETAILED DESCRIPTION OF THE PREFERRED EMBODIMENTS

Figure 1:
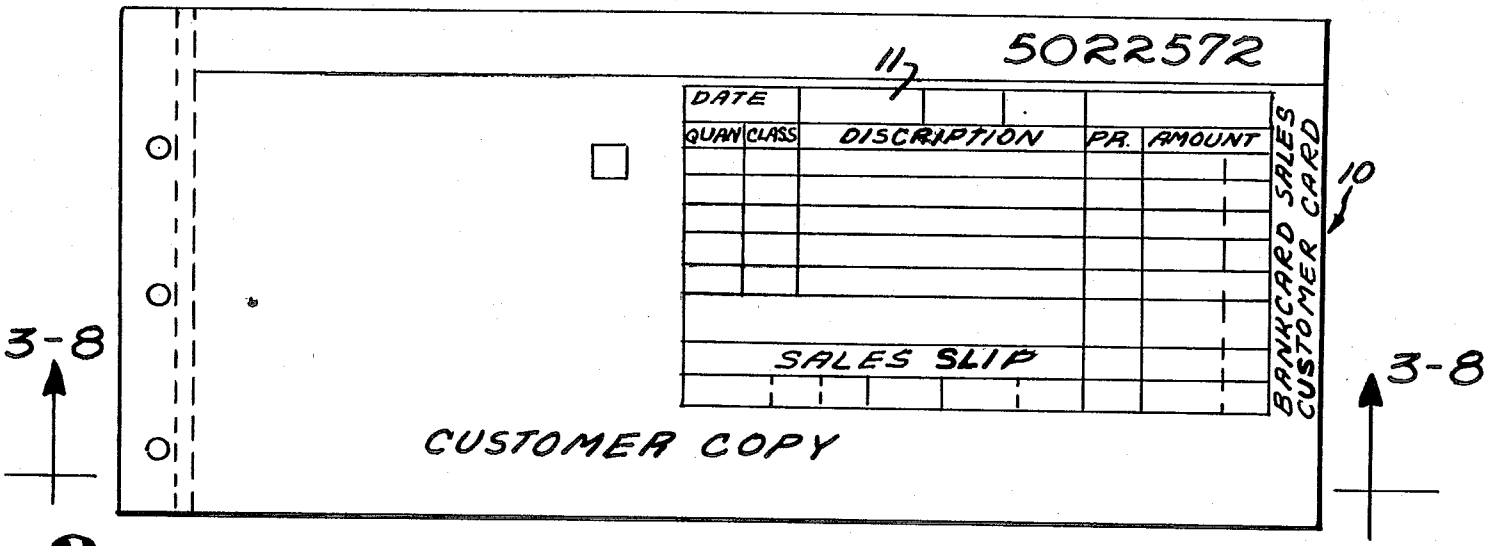
FIG. 1 is a top plan view of the credit card sales invoice set of the present invention.

FIG. 1 illustrates a credit card sales invoice set 10 of the present invention, which appears from its outer appearance to be a conventional sales invoice set.

Figure 2:
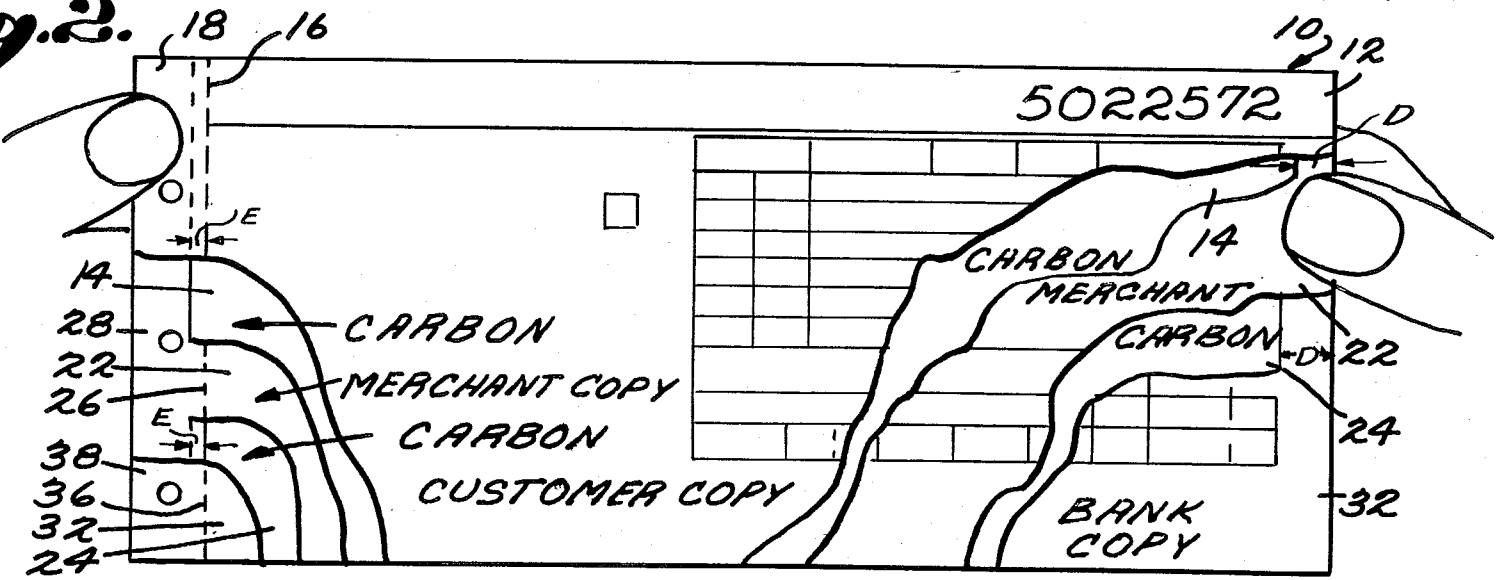
FIG. 2 is a partially broken away view of the credit card sales invoice about to have the merchant's or second card copy and the bank's or bottom card copy separated at perforation lines along the left marginal edge.

As shown in FIG. 2, there is a first or top card copy 12 for one of a group comprising a customer, a merchant and a bank, a second copy 22 which may be for another of the group, and a third card copy 32 which is for the remaining member of the group. A first carbon ply 14 is interleaved between the top card copy 12 and the middle card copy 22 while a second carbon ply 24 is interleaved between the middle card copy 22 and the bottom card copy 32. Along the right-hand margin the carbons 14 and 24 are shorter than the card copies 12, 22 and 32 by a distance "D" which allows the customer or an employee of the merchant to grip the copy 22 and the copy 32 simultaneously by thumb and finger before detaching copies 22 and 32 from the sales invoice set 10 as described below. Along the left-hand margin of the set 10 there is a three-part stub made up of top, middle and bottom, plies to which the copies 12, 22 and 32 are attached. The top card copy 12 may have a perforation line 16 so that the top copy 12 is detachable from the top stub ply 18. However, this line 16 is an optional feature to be used in a modification in which the customer desires to dispose of the three-part stub and the carbons 14 and 24 connected thereto. The middle card copy 22 is detachable along a perforation (line of weakening) line 26 from a middle stub ply 28. The bottom card copy 32 is detachable along a perforation line 36 from a bottom stub ply 38. The first carbon 14 is secured between the top stub ply 18 and the middle stub ply 28 by an adhesive applied along a thin edge E. The second carbon 24 is secured between the middle stub 28 and the bottom stub 38 by an identical adhesive applied along a similar thin edge E.

Figure 3:
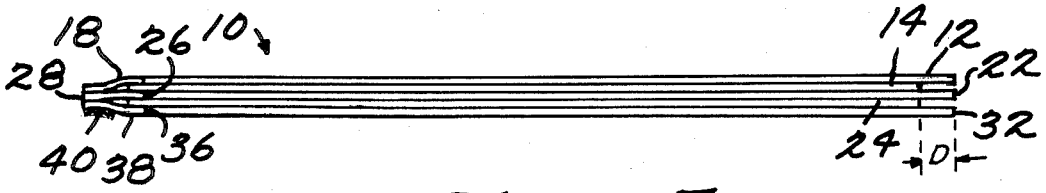
FIG. 3 is a side elevational view of a first preferred embodiment of the credit card sales invoice of the present invention.
Figure 4:
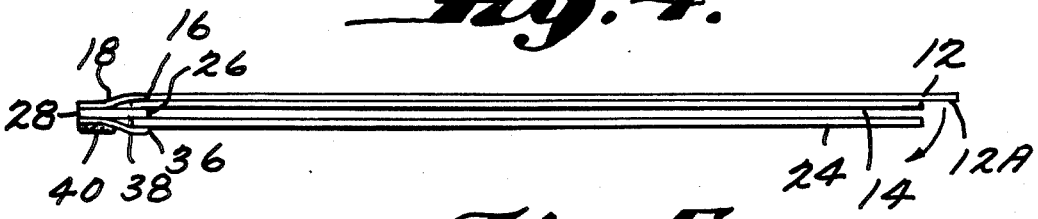
FIG. 4 is a side elevational view of the first preferred embodiment with the middle card copy and the bottom card copy removed.
Figure 5:
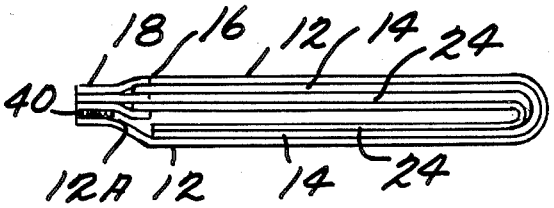
FIG. 5 is a side elevational view of the first preferred embodiment with the top card copy for the customer folded over and secured to an adhesive with the two carbons retained inside.
Figure 6:
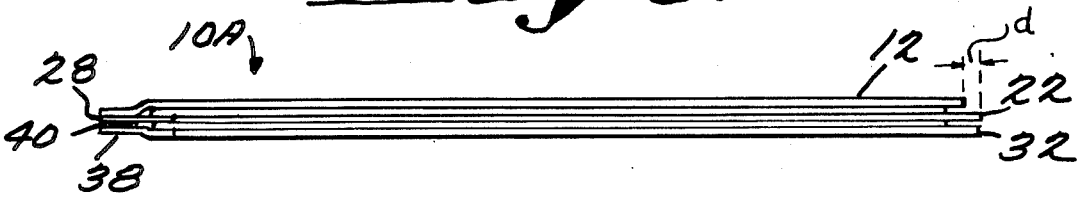
FIG. 6 is a side elevational view of a second preferred embodiment of the credit card sales invoice of the present invention.
Figure 7:
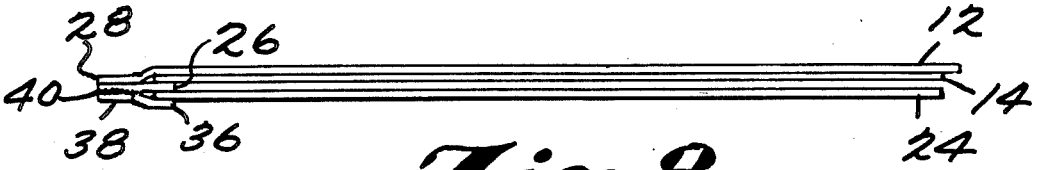
FIG. 7 is a side elevational view of the second preferred embodiment with the middle card copy and the bottom card copy removed.
Figure 8:
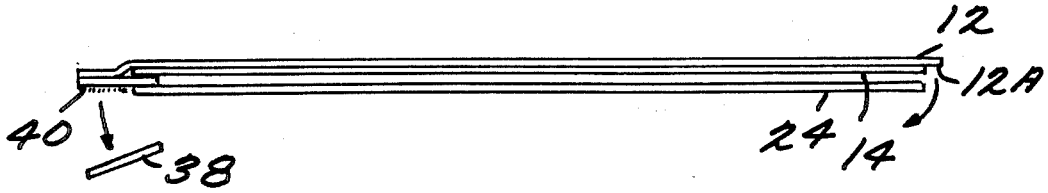
FIG. 8 is a side elevational view of the second preferred embodiment with the bottom stub being removed to expose an adhesive before the top card copy for the customer is folded over for attachment to the adhesive.

The use of the invention will now be described with regard to FIGS. 3–8, of which FIGS. 3–5 show a first embodiment and FIGS. 6–8 show a second embodiment. In these FIGURES the thickness of the plies has been exaggerated for sake of clarity.

As shown in FIG. 3, each sales invoice set 10 of the first embodiment has an adhesive layer 40 attached to the bottom of stub ply 38. An employee of the merchant would fill in the sales data on the top card copy 12, imprint the entire sales invoice set 10 with the customer's credit card, and then obtain the customer's signature. At this point in the sale transaction, either the customer or the merchant's employee flips up the top card copy 12 and grips the middle card copy 22 and the bottom card copy 32 along the marginal edges having the distance D. After also gripping the three-part stub along the left-hand margin, the customer or merchant's employee pulls on the middle card copy 22 and the bottom card copy 32 to separate such copies 22 and 32 along perforation lines 26 and 36, respectively.

As shown in FIG. 4, the middle copy 22 and the bottom copy 32 have been removed, leaving the carbons 14 and 24 intact with the top card copy 12 for the customer and the three stubs 18, 28 and 38 containing the adhesive layer 40 underneath. The arrow at the right-hand margin of FIG. 4 indicates the direction in which the remaining paper plies are folded.

As shown in FIG. 5, either the customer or preferably the merchant's employee then folds the remaining plies in half so that an exposed margin 12A underlying the top card copy 12 comes into contact with the adhesive layer 40, thus sealing the carbons 14 and 24 to prevent accidental soiling. The customer thereafter takes his or her card copy 12 and the carbons, thus assuring that the credit card data will not fall into unscrupulous hands.

This invention helps the customer prevent soiling fingers, clothing and/or other possessions with smudge marks from the carbons 14 and 24 because they are neatly folded upon themselves inside the top card copy 12 and are held securely by the adhesive layer 40.

However, as an added benefit, as may be seen in either FIGS. 4 or 5, the customer may optionally open the folded plies in order to discard the carbons 14 and 24 safely at one's convenience by separating the top card copy 12 from the top stub 18 along the perforation line 16. A statement may be printed on the face of the top card copy 12 advising the customer of the benefits of the security provided by the present invention.

FIGS. 6–8 show a second embodiment of the present invention. As illustrated in FIG. 6, the top card copy 12 is shorter in length by a distance "d" than the lengths of the middle card copy 22 and the bottom card copy 32. This distance "d" serves the same function as the distance "D" and is still sufficient to allow either the customer or the merchant's employee to remove the middle card copy 22 and the bottom card copy 32 without the necessity of flipping up the top card copy 12.

Another difference between the first embodiment shown in FIGS. 3–5 and the second embodiment shown in FIGS. 6–8 is that the second embodiment in FIGS. 6–8 clearly shows the absence of a perforation line, similar to line 16 in FIGS. 3–5, separating the top card copy 12 from the top stub 18. However, a perforation line 16 may be optionally provided with the second embodiment.

A further difference between the first embodiment of FIGS. 3–5 and the second embodiment of FIGS. 6–8 is that, as seen in the left-hand margin of FIG. 6, the adhesive layer 40 is provided between the middle stub ply 28 and the bottom stub ply 38.

As shown in FIG. 7, the latter change will allow the virtually identical use of a modified credit card sales invoice 10A up to the time after the middle card copy 22 and the bottom card copy 32 are removed from the middle stub 28 and the bottom stub 38 along perforation lines 26 and 36, respectively. Thus, the carbons 14 and 24 remain attached to the stub end.

As shown in FIG. 8, the bottom stub ply 38 is removed in order to expose the adhesive layer 40 before folding over the top card copy 12, as indicated by the arrow at the right-hand margin. Thereafter, the exposed margin 12A underlying the top card copy 12 may be folded under and placed into contact with the adhesive layer 40. Thus, the carbons 14 and 24 will be sealed inside by the top card copy 12 in a fashion similar to but not identical with the first embodiment, as shown in FIG. 5.

It also will be observed that the adhesive 40 could be on the top of the top ply of the stub and a folding over of the lower copy will capture the carbons for the above described purpose. In this way the bottom ply is for the customer, and the original signature of the customer which is placed on the top copy remains with the merchant or the bank (whichever wishes to have the original signature).

There are several benefits provided by the present invention. First, the customer is made aware that the merchant and the bank are interested in the security of credit card data. Second, the customer is provided with the discardable carbons 14 and 24 containing the sensitive credit card data. Third, the customer is provided with a clean copy of the top card 12 in such a manner that the carbons 14 and 24 will not soil the customer's body or articles that might come into contact therewith. Lastly, the customer may dispose of the carbons 14 and 24 at his or her convenience.

The foregoing preferred embodiments are considered illustrative only. Numerous other modifications and changes will readily occur to those persons skilled in the credit card industry after reading the foregoing specification. Consequently, the disclosed invention is not limited to the exact constructions and use shown and described above, and the scope of the invention is to be determined from the appended claims.

What is claimed is:

1. A credit card invoice set including:

a stub end having at least three plies affixed together, at least three invoice copies attached to the stub end plies to provide top, middle and bottom copies, a carbon ply attached to a ply of the stub end and extending between the top and middle copies, a carbon ply attached to a ply of the stub end and extending between the middle and bottom copies, a strip of reusable adhesive along a surface of a ply of the stub end, lines of weakening across at least two of the copies outward of the places of attachment of the carbon plies to the plies of the stub end, the arrangement being such that after removal of the two copies along the lines of weakening thereof the remaining copy may be folded over and the free end affixed to the adhesive strip with the carbon plies contained within the folded copy.

2. A set as in claim 1 in which the adhesive is positioned along the outer surface of the stub end ply which is opposite from the side of the stub end to which the folded copy is attached.

3. A set as in claim 1 in which the adhesive is positioned within the stub end on one side of the ply of the stub end to which the middle copy is attached, whereby the outer ply of the stub end from which the copy has been detached may be removed and the folded copy affixed to the adhesive.

4. A set as in claim 1 or claim 2 in which the folded copy intended for the customer involved in a transaction is on the top of the set and the adhesive is on the bottom of the bottom ply of the stub end.

5. A set as in claim 1 or claim 2 in which the folded copy intended for the customer involved in a transaction is on the bottom of the set and the adhesive is on the top of the top ply of the stub end.

* * * * *